US006710687B2

(12) United States Patent
Elms et al.

(10) Patent No.: US 6,710,687 B2
(45) Date of Patent: Mar. 23, 2004

(54) TEST BUTTON ASSEMBLY FOR CIRCUIT BREAKER

(75) Inventors: Robert T. Elms, Monroeville, PA (US); Michael J. Whipple, Rochester, PA (US)

(73) Assignee: Eaton Corporation, Cleveland, OH (US)

( * ) Notice: Subject to any disclaimer, the term of this patent is extended or adjusted under 35 U.S.C. 154(b) by 57 days.

(21) Appl. No.: 10/170,954

(22) Filed: Jun. 13, 2002

(65) Prior Publication Data

US 2003/0231089 A1 Dec. 18, 2003

(51) Int. Cl.[7] ..... H01H 83/06; H01H 73/00

(52) U.S. Cl. ..... 335/6; 335/7; 335/11; 335/13; 335/18; 361/42

(58) Field of Search ..... 335/6, 7, 11, 13, 335/18, 21, 22, 23, 35, 172, 173, 202; 361/42–50

(56) References Cited

U.S. PATENT DOCUMENTS 6,259,340 B1 7/2001 Fuhr et al.

6,392,513 B1 * 5/2002 Whipple et al. ..... 335/18

* cited by examiner

*Primary Examiner*—Ramon M. Barrera

(74) *Attorney, Agent, or Firm*—Martin J. Moran

(57) ABSTRACT

An improved test button assembly for use in a circuit breaker includes a frame and a button member, with the button member being pivotably mounted on the frame. A pair of microswitches are mounted on a printed circuit board that is disposed on the frame. The button member is alternately engageable with the two microswitches, with one of the microswitches being connectable with a ground fault protection circuit, and the other microswitch being connectable with an arc fault protection circuit. In an alternate embodiment, a common electrical contact is mounted on the button member, and a pair of contacts are mounted on the frame, with the common contact being alternately engageable with each of the contacts mounted on the frame. The contacts mounted on the frame are connected with the ground fault and arc fault protection circuits.

7 Claims, 5 Drawing Sheets

TEST BUTTON ASSEMBLY FOR CIRCUIT BREAKER

BACKGROUND OF THE INVENTION

1. Field of the Invention

The present invention relates generally to power distribution equipment and, more particularly, to a test button assembly for a circuit breaker.

2. Description of the Related Art

Circuit breakers and other power distribution equipment are well known in the relevant art. Circuit breakers are typically configured to interrupt current upon the occurrence of one or more predetermined conditions. For instance, circuit breakers may trip in the event of an overcurrent condition or an under-voltage condition, and they additionally trip in the event of a ground fault or an arc-fault condition if configured to do so. Protection from ground faults and arc faults typically is provided by circuitry within the circuit breaker that is operatively connected with a trip unit of the circuit breaker.

In order to ensure the continued proper and safe operation of such circuit breakers, the ground fault and arc fault detection circuitry is desirably tested on occasion. The testing of such ground fault and arc fault circuitry typically involves the closing of a pair of contacts within a testing circuit that simulates the fault condition. Upon closing of the contacts and simulation of the fault condition, a successful test of the fault detection circuitry will result in the trip unit of the circuit breaker performing a trip operation. The circuit breaker can then be reset. While such testing circuitry has been generally effective for its intended purpose, such testing circuitry has not, however, been without limitation.

Circuit breakers generally are designed in such a fashion to minimize the space occupied thereby. As such, the contacts that are closed in order to test ground fault and arc fault circuitry typically have been mounted directly onto a main printed circuit board of the circuit breaker. In some instances the contacts have been configured as leaf springs that protrude from the main printed circuit board and are deflected into contact with one another in order to close the ground fault or arc fault protection circuit.

The deflection of such leaf spring contacts undesirably results in forces and torques being applied to the main printed circuit board. Since numerous other circuitry components of the circuit breaker are mounted on the main printed circuit board, such forces and torques can result in breakage or other failure of the main printed circuit board and thus the circuit breaker.

Additionally, since such contacts are disposed internally within the circuit breaker, some type of linkage or other motion transfer mechanism must be provided which operatively extends between the contacts and the exterior of the circuit breaker to permit the contacts to be closed from the exterior of the circuit breaker. Such linkages and the like occupy additional space within the circuit breaker and are often less than fully reliable in closing the contacts of the protection circuitry. Such contacts and linkages additionally have been relatively expensive to incorporate into a circuit breaker.

It is thus desired to provide an improved test button assembly for a circuit breaker that overcomes these and other shortcomings of previously known test button designs.

SUMMARY OF THE INVENTION

Accordingly, an improved test button assembly for use in a circuit breaker includes a frame and a button member, with the button member being pivotably mounted on the frame. A pair of microswitches are mounted on a printed circuit board that is disposed on the frame. The button member is alternately engageable with the two microswitches, with one of the microswitches being connectable with a ground fault protection circuit, and the other microswitch being connectable with an arc fault protection circuit. In an alternate embodiment, a common electrical contact is mounted on the button member, and a pair of contacts are mounted on the frame, with the common contact being alternately engageable with each of the contacts mounted on the frame. The contacts mounted on the frame are connected with the ground fault and arc fault protection circuits.

Accordingly, an aspect of the present invention is to provide an improved test button assembly that is relatively less expensive to manufacture and incorporate into a circuit breaker than previously known test button systems.

Another aspect of the present invention is to provide an improved test button assembly that is relatively more reliable in function than previously known test button systems.

Another aspect of the present invention is to provide an improved test button assembly that is modular in nature.

Another aspect of the present invention is to provide an improved test button assembly that is configured such that the operation thereof imparts generally no forces or torques to a main circuit board of the circuit breaker.

Another aspect of the present invention is to provide an improved test button assembly for a circuit breaker that occupies minimal space within the circuit breaker.

Another aspect of the present invention is to provide an improved circuit breaker that employs an improved test button assembly.

Accordingly, an aspect of the present invention is to provide a test button assembly for a circuit breaker, the circuit breaker including a first protection system and a second protection system, the circuit breaker including a case formed with a receptacle, in which the general nature of the test button assembly can be stated as including a frame, a button member, the button member being mounted on the frame, the button member being movable with respect to the frame, a first contact, the first contact being disposed on the frame, the first contact being structured to be electrically conductively connected with the first protection system, a second contact, the second contact being disposed on the frame, the second contact being structured to be electrically conductively connected with the second protection system, a common contact, the common contact being operatively connected with the button member, the common contact being movable by the button member to be electrically conductively connectable with the first contact, the common contact being movable by the button member to be electrically conductively connectable with the second contact, and the test button assembly being a discrete unit that is structured to be received in the receptacle and mounted to the case of the circuit breaker as a single assembly.

Another aspect of the present invention is to provide a test button assembly for a circuit breaker, the circuit breaker including a first protection system and a second protection system, the circuit breaker including a case formed with a receptacle, in which the general nature of the test button assembly can be stated as including a frame, a first microswitch, the first microswitch being disposed on the frame, the first microswitch being structured to be electrically conductively connected with the first protection system, a second microswitch, the second microswitch being disposed on the frame, the second microswitch being structured to be electrically conductively connected with the second protection system, a button member, the button member being mounted on the frame, the button member being movable with respect to the frame, the button member being operatively engageable with the first microswitch, the button member being operatively engageable with the second microswitch, and the test button assembly being a discrete unit that is structured to be received in the receptacle and mounted to the case of the circuit breaker as a single assembly.

Another aspect of the present invention is to provide a circuit breaker the general nature of which can be stated as including a case, a trip unit, the trip unit being disposed within the case, a line conductor, a load conductor, the line and load conductors being electrically conductively connectable with one another, the trip unit being operative to electrically conductively connect and disconnect the line and load conductors, a first protection system, the first protection system being operatively connected with the trip unit, a second protection system, the second protection system being operatively connected with the trip unit, a test button assembly, the test button assembly including a first microswitch, the test button assembly including a second microswitch, the test button assembly including a support, the first microswitch being mounted on the support, the second microswitch being mounted on the support, the support being disposed on the case, the first microswitch being operatively connected with the first protection system, and the second microswitch being operatively connected with the second protection system.

BRIEF DESCRIPTION OF THE DRAWINGS

A further understanding of the invention can be gained from the following description of the preferred embodiments when read in conjunction with the accompanying drawings in which.

Similar numerals refer to similar parts throughout the specification.

DESCRIPTION OF THE PREFERRED EMBODIMENTS

Figure 1:
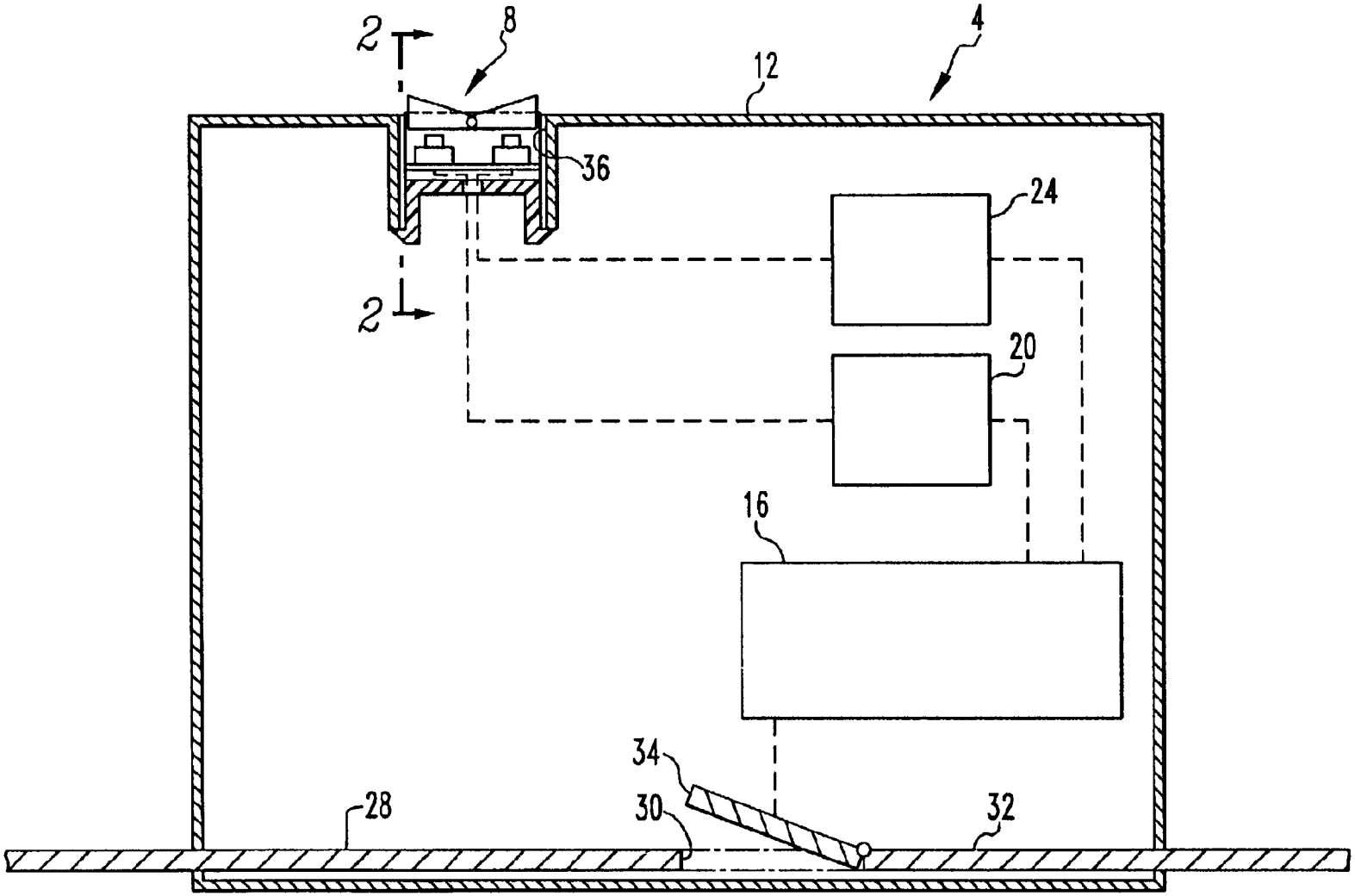
FIG. 1 is a schematic cut-away view of an improved circuit breaker in accordance with the present invention that incorporates an improved test button assembly in accordance with a first embodiment of the present invention.

A circuit breaker 4 in accordance with the present invention is illustrated schematically in FIG. 1. The circuit breaker 4 is advantageously configured to include a test button assembly 8 in accordance with a first embodiment of the present invention. The test button assembly 8 is employed for the testing of protection circuitry of the circuit breaker 4. The test button assembly 8 is advantageously of a modular configuration, as will be set forth more fully below.

The circuit breaker 4 includes a case 12, a trip unit 16, a first protection system 20, a second protection system 24, a first conductor 28, and a second conductor 32. The trip unit 16, the first protection system 20, and the second protection system 24 are disposed within the case 12. The first conductor 28 and the second conductor 32 each extend between the interior of the case 12 and the exterior thereof. As is well known in the relevant art, the first and second conductors 28 and 32 may be line and load conductors, respectively, and include contacts 30 and 34, respectively. The contacts 30 and 34 are engaged with one another (not shown in FIG. 1) such that the first and second conductors 28 and 32 are electrically conductively connected with one another during normal operation of the circuit breaker 4. The contacts 30 and 34 are disengaged from one another by the trip unit 16 upon the occurrence of one or more specified conditions to disconnect the first and second conductors 28 and 32 from one another, all in a known fashion. The first and second conductors 28 and 32 are intended to be connected with a line and a load, as is well understood in the relevant art.

The trip unit 16 can include one or more of any of a wide variety of trip systems such as thermal trip systems, magnetic armature trip systems, under-voltage trip systems, and the like in a well understood fashion. The first and second protection system 20 and 24 can likewise each be any of a variety of protection systems such as ground fault protection systems and arc fault protection systems. As can be understood from FIG. 1, the first and second protection systems 20 and 24 are each operatively connected with the trip unit such that upon the occurrence of a specified condition, either or both of the first and second protection systems 20 and 24 will trigger the trip unit 16 to disconnect the first and second conductors 28 and 32 in order to interrupt the current through the circuit breaker 4 in a well understood fashion.

As can further be understood from FIG. 1, the case 12 is formed to include a receptacle 36. The test button 8 is advantageously received in the receptacle 36 and is thereby disposed on the case 12. As such, the test button assembly 8 advantageously is not mounted on either of the first and second protection systems 20 and 24 or on a main printed circuit board (not explicitly depicted in FIG. 1) upon which the first and second protection systems 20 and 24 may be mounted.

Figure 2:
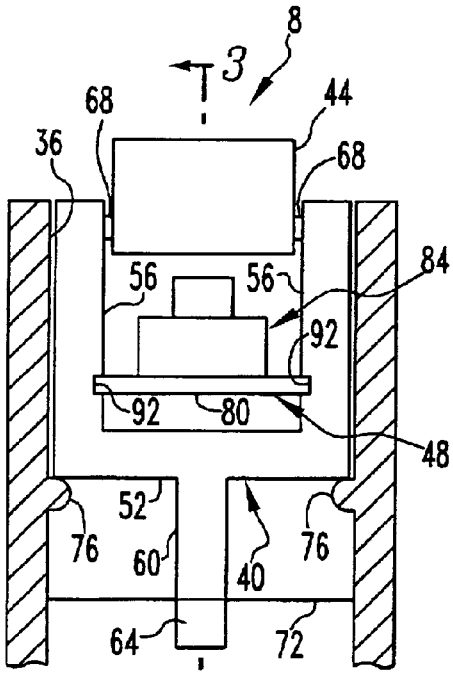
FIG. 2 is a sectional view as taken along line 2—2 of FIG. 1.
Figure 3:
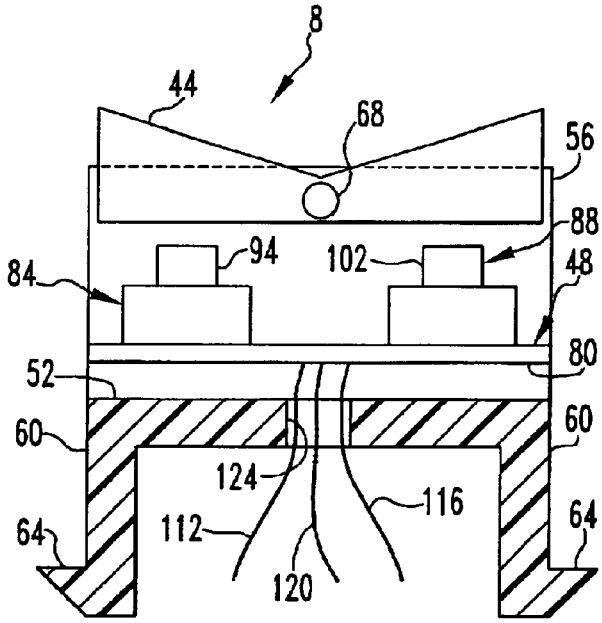
FIG. 3 is a sectional view as taken along line 3—3 of FIG. 2.

As can be understood from FIGS. 2 and 3, the test button assembly 8 includes a frame 40, a button member 44, and a switch assembly 48. The button member 44 and the switch assembly 48 are both mounted on the frame 40, whereby the test button assembly 8 is modular in nature and can be readily mounted onto the case 12 of the circuit breaker 4. As used herein, the term "modular" and variations thereof refers to a condition in which multiple components or parts are connected with one another in such a fashion that the components or parts together form a discrete unit or module that can be handled and employed as a single assembly. In the context of the test button assembly 8, the test button assembly 8 is a discrete unit or module that can be mounted as a single assembly on the circuit breaker 4 by slidingly receiving the test button assembly 8 in the receptacle 36 of the case 12, as will be set forth more fully below.

The frame 40 includes a base 52, a pair of parallel and spaced apart walls 56 extending from the base 52, and a pair of legs 60 that each include a locking tab 64 and that extend away from the base 52. The base 52 and the walls 56 together are generally U-shaped. The legs 60 extend away from the base 52 in a direction opposite the walls 56.

The button member 44 includes a pair of axially aligned pins 68 that are pivotably mounted in correspondingly sized and positioned holes (not shown) formed in the walls 56. In the embodiment of the test button assembly 8 depicted in the accompanying figures, the button member 44 does not itself include a spring or other structure to bias the button member 44 to a particular position, and rather is free to pivotably float. It is understood, however, that such a spring or other biasing structure could be added to the test button assembly 8 without departing from the concept of the present invention.

During mounting of the test button assembly 8 to the case 12, the test button assembly 8 is translated toward the case 8 to receive the legs 60 in the receptacle 36. The engagement of the locking tabs 64 with the walls of the receptacle causes the legs 60 to deflect generally toward one another. The receptacle 36 terminates at a pair of opposed ledges 72. As the test button assembly 8 further slidingly received in the receptacle 36, the locking tabs 64 ultimately move past the ledges 72, and the legs 60 spring back into the position depicted in FIG. 3 so that the test button assembly 8 snaps into place.

As can be understood from FIG. 2, the case 12 also includes a pair of stops 76 formed on the interior of the receptacle 36 for engagement with the base 52. It thus can be seen that the locking tabs 64 function as mounting structures that permit the test button assembly 8 to be lockably engaged with the case 12. Moreover, the test button assembly 8, being of a modular configuration, is received in the receptacle 36 and is thus mounted on the case 12 as a discrete unit. While the ledges 72 and the stops 76 together fixedly retain the test button assembly 8 within the receptacle 36, it is understood that other structures and assembly methodologies may be employed to retain the test button assembly 8 in the receptacle 36.

As can be understood from FIGS. 2 and 3, the switch assembly 48 includes a generally planar support 80, a first microswitch 84, and a second microswitch 88. The switch assembly 48 further includes a first wire 112, a second wire 116, and a common wire 120 that extend from the support 80. The support 80 may be any of a wide variety of structural support members and may be a small printed circuit board. It can be seen that the support 80 is received in a pair of confronting notches 92 (FIG. 2) formed in the walls 56.

The first and second microswitches 84 and 88 are substantially identical to one another, although such identity is not essential to the operation of the test button assembly 8. The first microswitch 84 includes a first plunger 94, a first terminal 96, and a second terminal 100. Similarly, the second microswitch 88 includes a second plunger 102, a first terminal 104, and a second terminal 108. As is understood in the relevant art, the first plunger 94 is movable and is operable to change the first microswitch 84 between an open condition in which the first and second terminals 96 and 100 are electrically conductively disconnected from one another and a closed condition in which the first and second terminals 96 and 100 are electrically conductively connected together. The first plunger 94 is spring biased to the open condition. The second plunger 102 is similarly movable and operable to change the second microswitch 88 between open and closed positions in which the first and second terminals 104 and 108 are disconnected and connected together, respectively. The second plunger 102 is spring biased to the open condition. The first and second microswitches 84 and 88 may, for instance, each be a Mechanical Keyswitch B3F-1000 sold by Omron Electronics, Inc., of Schaumburg, Ill., USA, although other switches from other manufacturers may be employed without departing from the concept of the present invention.

Figure 4:
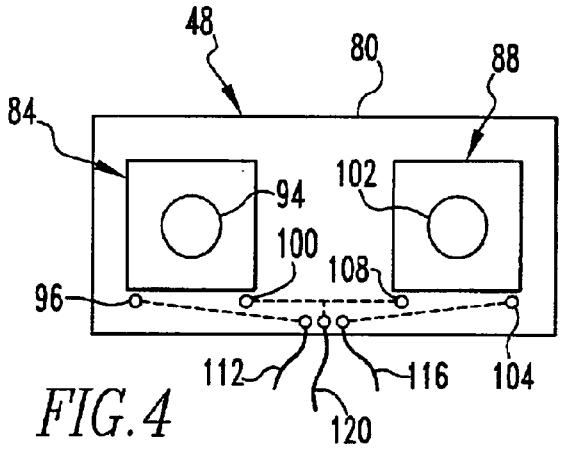
FIG. 4 is a top plan view of a switch assembly of the first embodiment.

As can be understood from FIG. 4, the first terminal 96 of the first microswitch 84 is electrically conductively connected with the first wire 112. The first wire 112 is electrically conductively connected with the first protection system 20. Similarly, the first terminal 104 of the second microswitch 88 is electrically conductively connected with the second wire 116. The second wire 116 is electrically conductively connected with the second protection system 24. It can further be seen that the second terminals 100 and 108 are electrically conductively connected with one another and with the common wire 120.

Figure 5:
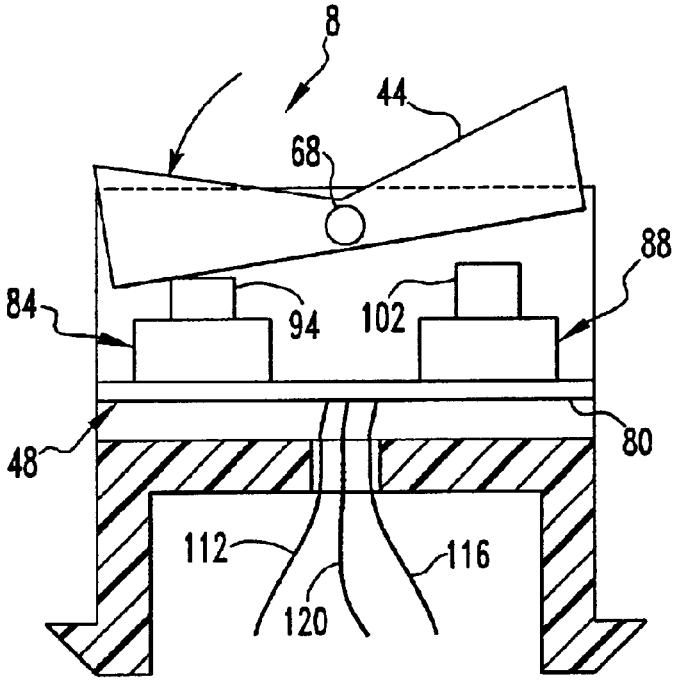
FIG. 5 is a view similar to FIG. 3, except depicting a button member of the first embodiment operatively engaged with a first microswitch of the first embodiment.
Figure 6:
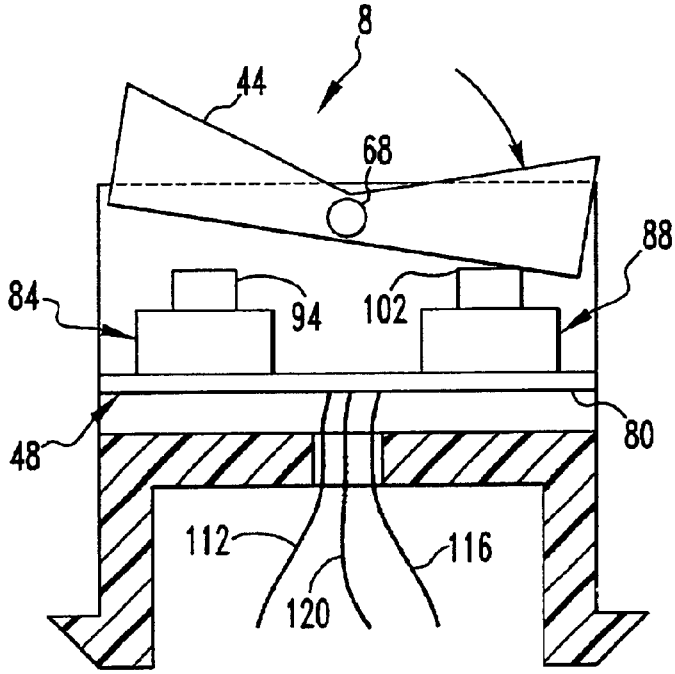
FIG. 6 is view similar to FIG. 5, except depicting the button member operatively engaged with a second microswitch of the first embodiment.
Figure 7:
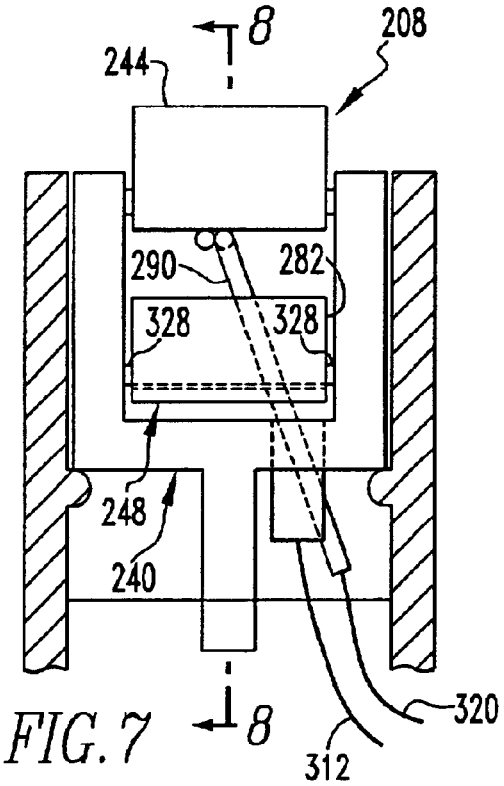
FIG. 7 is a sectional end view of an improved test button assembly in accordance with a second embodiment of the present invention.
Figure 8:
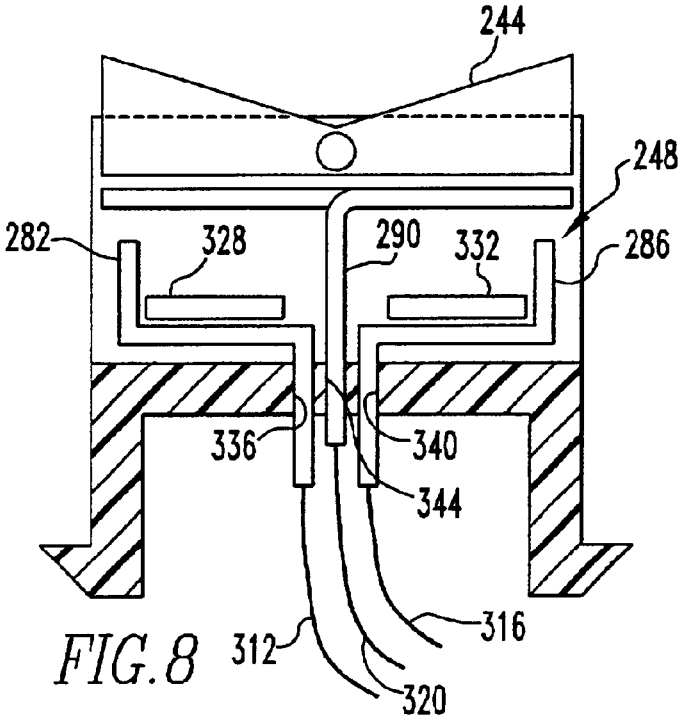
FIG. 8 is a sectional view as taken along line 8—8 of FIG. 7.

It thus can be understood that when the button member 44 is moved into operative engagement with the first microswitch 84, as is depicted generally in FIG. 5, the first plunger 94 is depressed by the button member 44 which places the first microswitch 84 in the closed condition in which the first and second terminals 96 and 100 are connected with one another. Such a circumstance closes the circuit of the first protection system 20 which, if in proper operating condition, triggers the trip unit 16 to separate the first and second conductors 28 and 32. Similarly, when the button member 44 is in operative engagement with the second microswitch 88, as is generally depicted in FIG. 6, the second plunger 102 is depressed by the button member 44 which electrically conductively connects the first and second terminals 104 and 108 which closes the circuit of the second protection system 24. If the second protection system 24 is in proper operating condition it triggers the trip unit 16 to separate the first and second conductors 28 and 32. In such fashion, the first and second protection systems 20 and 24 can be tested.

It can be seen from FIG. 3 that the first, second, and common wires 112, 116, and 120 extend from the support 80 through a hole 124 formed in the base 52 for connection with the appropriate components of the circuit breaker 4. It is understood, however, that in other embodiments of the test button assembly 8, the first, second, and common wires 112, 116, and 120 may be routed in a different fashion and thus may not extend through any such hole 124.

It thus can be seen that the test button assembly 8 is of a modular configuration and can be received in the receptacle 36 and secured therein by the engagement of the locking tabs 64 with the ledges 72 and the engagement of the base 52 with the stops 76. With the test button assembly 8 installed as such, the first, second, and common wires 112, 116, and 120 can be electrically conductively connected with appropriate components within the circuit breaker 4 such that the first microswitch 84 is operatively connected with the first protection system 20 and the second microswitch 88 is operatively connected with the second protection system 24. The test button assembly 8 is relatively small in physical size, with the size thereof being generally dictated by and limited by the size of the first and second microswitches 84 and 88. Depending upon the availability of other microswitches, the test button assembly 8 can be configured to be even more compact than that explicitly depicted herein.

Since the first and second microswitches 84 and 88 include first and second plungers 94 and 102 that are biased to the open condition, the button member 44 need not be separately biased to a neutral position but rather may be permitted to pivotably float while being retained between the walls 56. Furthermore, the test button assembly 8 is operated without applying any forces or torques to any components of the circuit breaker 4 other than the case 12. As such, the potential for breakage or other failure of a main printed circuit board or other components of the circuit breaker 4 due to the application of forces or torques thereto is substantially alleviated.

It is understood that the test button assembly 8 depicted in the accompanying figures is merely exemplary in nature and can be configured in numerous different fashions without departing from the concept of the present invention. For instance, the notches 92 could be formed in the case 12, with the support 80 being received in such notches. In such fashion, the frame 40 could be eliminated from the test button assembly 8. Moreover, the switch assembly 48 could be additionally or alternatively disposed such that the first and second plungers 94 and 102 protrude slightly through correspondingly sized and positioned holes formed in a cover extending over the receptacle 36 such that the first and second plungers 94 and 102 could be manually engaged. Such a configuration would additionally eliminate the need for a button member 44. Such alternate configurations of the test button assembly 8 could be incorporated into the circuit breaker 4 depicted generally in FIG. 1 without the departing from the concept of the present invention.

It is noted, however, that the button member 44 of the present invention is configured to function as a rocker to alternately test the first and second protection systems 20 and 24. As such, a user can advantageously determine which of the first and second protection systems 20 and 24, if either, is functioning improperly. If the first and second protection systems 20 and 24 were tested simultaneously, one could not determine whether or not one of the first and second protection systems 20 and 24 was malfunctioning unless both were malfunctioning.

A second embodiment of a test button assembly 208 is indicated generally in FIGS. 7–10. The test button assembly 208 includes a frame 240 and a button member 244 that are substantially similar to those of the test button assembly 8. The test button assembly 208 includes a switch assembly 248, however, that includes a first bar 282, a second bar 286, and a common bar 290. The first and second bars 282 and 286 are mounted on the frame 240 and are retained in position by a pair of first protrusions 328 and a pair of second protrusions 332, respectively, formed on the frame 240.

The common bar 290 is a reentrantly formed generally T-shaped member that is made from a single bar of spring wire that is bent to such shape. The common bar 290 is engaged with the button member 244 and biases the button member 244 to a neutral position that is depicted generally in FIG. 8.

It can further be seen that the first bar 282 extends through a first hole 336 and is connected with a first wire 312. The second bar 286 extends through a second hole 340 and is connected with a second wire 316. The common bar 290 extends through a third hole 344 and is connected with a common wire 320. It is understood, of course, that the first, second, and common wires 312, 316, and 320 could be routed in different fashions. The first, second, and common wires 312, 316, and 320 are connectable in a fashion similar to the first, second, and common wires 112, 116, and 120 of the test button assembly 8.

Figure 9:
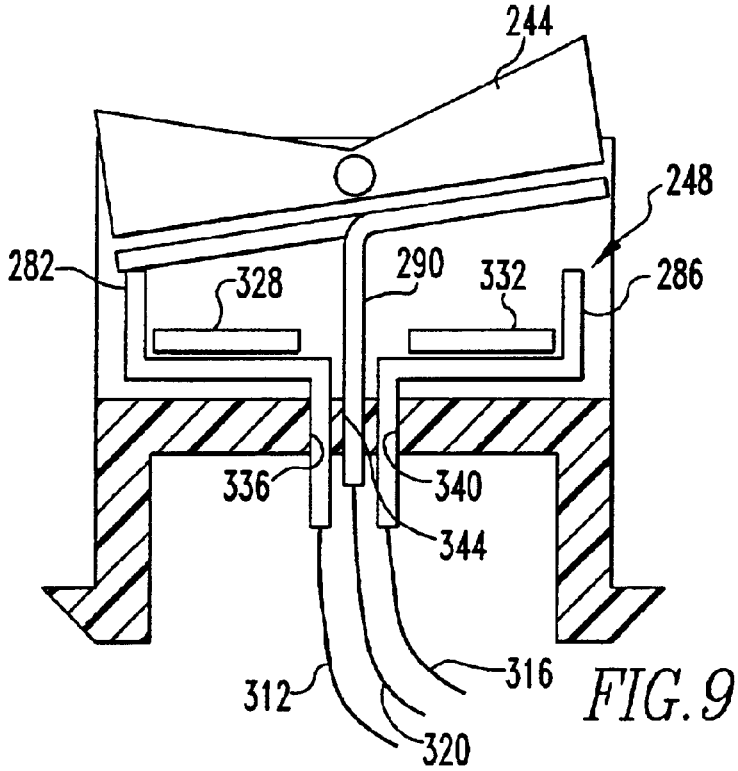
FIG. 9 is a view similar to FIG. 8, except depicting a common contact of the second embodiment electrically conductively engaged with a first contact of the second embodiment.
Figure 10:
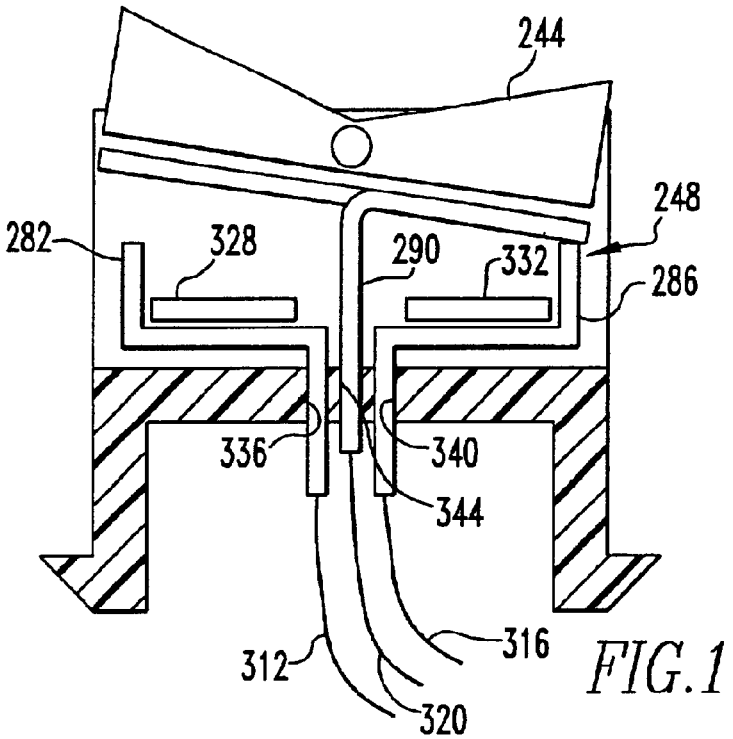
FIG. 10 is view similar to FIG. 9, except depicting the common contact electrically conductively connected with a second contact of the second embodiment.

It can be seen from FIG. 9 that the button member 244 is pivotable to a first position in which the common bar 290 is electrically conductively connected with the first bar 282 which completes a first circuit. Similarly, the button member 244 can be pivoted to a second position (FIG. 10) in which the common bar 290 is electrically conductively connected with the second bar 286, which completes a second circuit. The common bar 290 is alternately electrically conductively connectable with the first and second bars 282 and 286.

It thus can be seen that the test button assembly 208 could be substituted for and have a similar operation to that of the test button assembly 8. In such fashion, the first wire 312 could be electrically conductively connected with the first protection system 20, and the second wire 316 could be electrically conductively connected with the second protection system 24. Moreover, the test button assembly 208 could be incorporated into the circuit breaker 4 depicted generally in FIG. 1.

The test button assemblies 8 and 208 thus are modular in configuration, and the operation thereof generally applies no forces to any components of the circuit breaker 4 other than to the case 12. The test button assemblies 8 and 208 are relatively inexpensive to manufacture and are reliable in their operation and advantageously do not increase the potential for breakage or other failure of the main circuit board or other components of the circuit breaker 4.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A circuit breaker comprising:

a case;

a trip unit;

the trip unit being disposed within the case;

a line conductor;

a load conductor;

the line and load conductors being electrically conductively connectable with one another;

the trip unit being operative to electrically conductively connect and disconnect the line and load conductors;

a first protection system;

the first protection system being operatively connected with the trip unit;

a second protection system;

the second protection system being operatively connected with the trip unit;

a test button assembly;

the test button assembly including a first microswitch;

the test button assembly including a second microswitch;

the test button assembly including a support;

the first microswitch being mounted on the support;

the second microswitch being mounted on the support;

the support being disposed on the case;

the first microswitch being operatively connected with the first protection system; and the second microswitch being operatively connected with the second protection system.

2. The circuit breaker as set forth in claim 1, in which the first microswitch includes a first terminal;

the first terminal of the first microswitch being electrically conductively connected with the first protection system;

the first microswitch including a second terminal;

the second microswitch including a first terminal;

the first terminal of the second microswitch being electrically conductivity connected with the second protection system;

the second microswitch including a second terminal;

the second terminals of the first and second microswitches being electrically conductively connected together.

3. The circuit breaker as set forth in claim 2, in which the first and second microswitches each include a plunger;

each plunger being operable to change the respective microswitch between an open condition in which the first and second terminals at the respective microswitch are electrically conductively disconnected from one another and a closed condition in which the first and second terminals of the respective microswitch are electrically conductively connected together.

4. The circuit breaker as set forth in claim 1, in which the test button assembly includes a frame;

the support being disposed on the frame;

the frame being disposed on the case.

5. The circuit breaker as set forth in claim 4, in which the test button assembly includes a button member;

the button member being mounted on the frame;

the button member being movable with respect to the frame;

the button member being operatively engageable with the first microswitch;

the button member being operatively engageable with the second microswitch.

6. The circuit breaker as set forth in claim 5, in which the button member is pivotable with respect to the frame.

7. The circuit breaker as set forth in claim 5, in which the test button assembly is a discrete unit that is received in the receptacle and mounted to the case of the circuit breaker as a single assembly.

* * * * *